US005699650A

United States Patent [19]

Gray

[11] Patent Number: 5,699,650

[45] Date of Patent: Dec. 23, 1997

[54] DUAL TEMPERATURE HOT WATER SHRINK SYSTEM

[75] Inventor: Stephen L. Gray, Moore, S.C.

[73] Assignee: W. R. Grace & Co.-Conn., Duncan, S.C.

[21] Appl. No.: 661,239

[22] Filed: Jun. 10, 1996

[51] Int. Cl.[6] ..... B65B 53/02

[52] U.S. Cl. ..... 53/442; 53/557

[58] Field of Search ..... 53/442, 557; 34/216, 34/217, 225, 218, 233

[56] References Cited

U.S. PATENT DOCUMENTS

| | | | |
|---|---|---|---|
| 3,678,244 | 7/1972 | Worline | 53/557 X |
| 4,738,082 | 4/1988 | Saitoh | 53/557 |
| 5,193,290 | 3/1993 | Tolson | 53/442 X |
| 5,400,570 | 3/1995 | Bennett | 53/442 |

FOREIGN PATENT DOCUMENTS

| | | | |
|---|---|---|---|
| 4294719 | 10/1992 | Japan | 53/442 |
| 585509 | 4/1993 | Japan | 53/557 |
| 2119341 | 11/1983 | United Kingdom | 53/557 |
| 8912577 | 12/1989 | WIPO | 53/442 |

*Primary Examiner*—Linda Johnson
*Attorney, Agent, or Firm*—Mark B. Quatt

[57] ABSTRACT

A process for shrinking a package having a top, end seals, and bottom includes heating water until the water reaches a temperature of between 180° F. and 210° F., applying a first portion of the heated water to the bottom and end seals of the package, mixing a second portion of the heated water with water having a temperature lower than the heated water to provide cooled water, and applying the cooled water to the top of the package. An apparatus for shrinking a package having a top, end seals, and bottom includes means for heating water until the water reaches a temperature of between 180° F. and 210° F.; means for applying a first portion of the heated water to the bottom and end seals of the package; means for mixing a second portion of the heated water with water having a temperature lower than the heated water to provide cooled water; and means for applying the cooled water to the top of the package.

16 Claims, 2 Drawing Sheets

DUAL TEMPERATURE HOT WATER SHRINK SYSTEM

BACKGROUND OF THE INVENTION

The present invention relates to an apparatus and process for shrinking thermoplastic films, more particularly packaging films, especially films useful in packaging food products such as poultry.

In the packaging of products, especially food products such as poultry, PVC (polyvinyl chloride) has been a traditional packaging material.

PVC suffers from several deficiencies, including environmental concerns about possible migration of vinyl chloride monomer residuals, as well as plasticizer, into a food product packaged with PVC. PVC sometimes has lower abuse resistance and poorer memory than alternative packaging materials.

More recently, olefinic materials such as SSD film and SES film provided by the Cryovac Division of W. R. Grace & Co.-Conn. have proven useful in packaging articles such as poultry. These olefinic materials have excellent heat shrink properties.

Films of this type have proven particularly useful in packaging trayed poultry. Equipment useful in this industry includes that provided by Ossid. Examples include the Ossid 500 and 750, and various modifications of this machinery. Packages are typically made on these systems by providing a polystyrene tray, placing a product such as cut poultry into the tray, and overwrapping the product and tray with a thermoplastic shrink film. The overwrapped film is then trim sealed at the edges of the tray. The packaged product is then run through a hot water shrink tunnel to shrink the packaging film around the tray and product. Various tunnels are commercially available. The shrink step is performed in order to give a good package appearance and reduce sealed end flaps. Typically, a very high temperature water (typically around 200° F.) is needed to accomplish this. Unfortunately, this temperature will also sometimes partially cook the poultry product, and this is generally not acceptable to the food processor.

One possible solution is simply to keep the process water at a lower temperature. If this is done, the partial cooking of the packaged product can be avoided, but the packaging film may remain excessively loose. This results in a package with a poor appearance, including large end seal flaps. Such a package may not be commercially acceptable.

One currently commercial system is a two stage shrink system available from Cryovac. The first stage is a 6582A™ hot air system, where the package is subjected to air heated to about 300° F. Because of the poor heat capacity of air, the package is not fully shrunk. Thus, a second stage includes a 3072F™ hot water shrink tunnel, where the water is heated to about 180° F.

This dual stage system is cumbersome in that it requires a two stage process for properly shrinking each package, and also requires two different heating media (hot air and hot water) with all the ancillary equipment needed to supply the hot air and hot water.

Another currently commercial system is the RS 550S™ hot water tunnel available from DuPont, in which "staged" shrinking of overwrapped poultry products is done. This system is discussed in more detail below. The shrinking process is broken into stages so that the desired final package appearace is achieved. This system unfortunately utilizes the same source of very hot water used in the earlier stages, onto the top of the package as well, exposing the package to the "partial cooking" problem discussed above.

It is thus desirable to use a single heating medium with high heat capacity (i.e. hot water) in a one-stage system, and high enough temperatures for properly shrinking each package, but without partial cooking of the packaged product.

Faced with this challenge, the present invention offers a solution in the form of a single stage, single-medium shrink system and process, as summarized and described below.

This overall system allows the package to be properly shrunk, but without cooking the food product. It may also be less abusive on the print logo that appears on the top of the package.

SUMMARY OF THE INVENTION

In one aspect of the invention, a process for shrinking a package having a top, end seals, and bottom comprises heating water until the water reaches a temperature of between 180° F. and 210° F., applying a first portion of the heated water to the bottom and end seals of the package, mixing a second portion of the heated water with water having a temperature lower than the heated water to provide cooled water, and applying the cooled water to the top of the package.

In a second aspect of the invention, an apparatus for shrinking a package having a top, end seals, and bottom comprises means for heating water until the water reaches a temperature of between 180° F. and 210° F.; means for applying a first portion of the heated water to the bottom and end seals of the package; means for mixing a second portion of the heated water with water having a temperature lower than the heated water to provide cooled water; and means for applying the cooled water to the top of the package.

In a third aspect of the invention, a process for shrinking a package, the package having a top, end seals, and bottom, comprises: heating water until the water reaches a temperature of between 180° F. and 210° F.; applying a first portion of the heated water to the bottom and end seals of the package; cooling a second portion of the heated water until the second portion of water has a temperature lower than the heated water, in order to provide cooled water; and applying the cooled water to the top of the package.

BRIEF DESCRIPTION OF THE DRAWINGS

The invention may be further understood with reference to the drawings in which.

DESCRIPTION OF THE PREFERRED EMBODIMENTS

Figure 1:
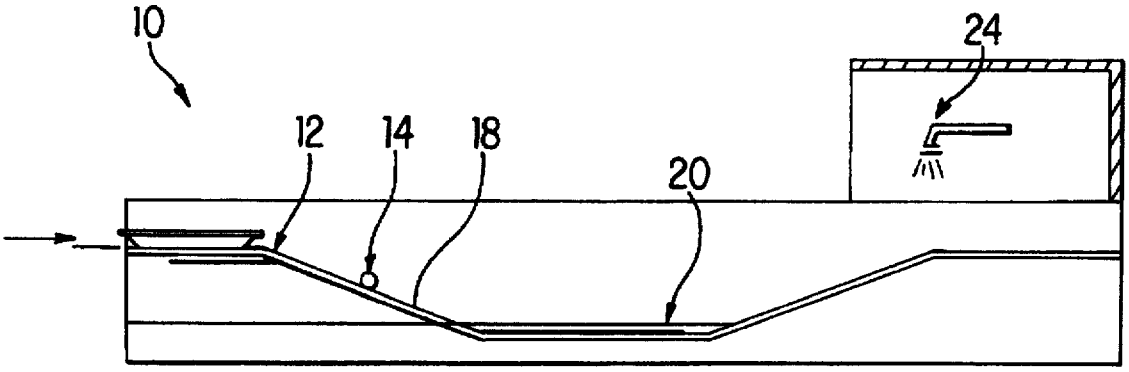
FIG. 1 PRIOR ART
FIGS. 1 and 2 show a side and top schematic view respectively of a prior art shrink tunnel.
Figure 2:
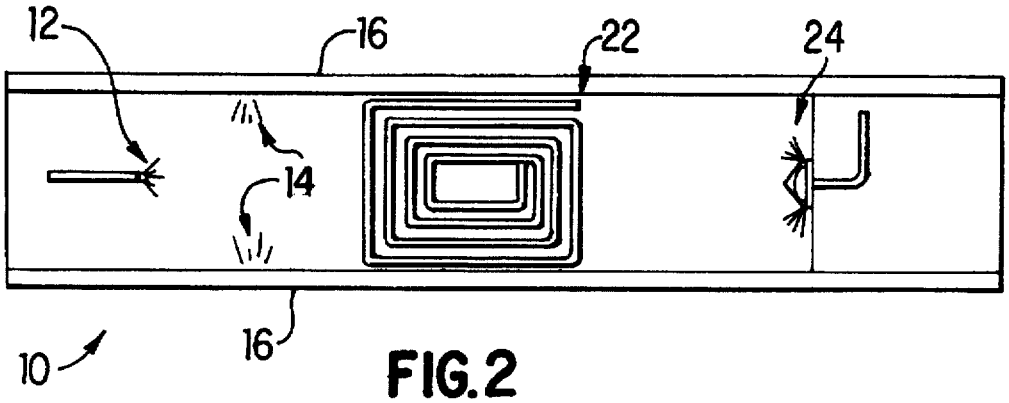
FIG. 2 PRIOR ART

In FIGS. 1 and 2, a prior art shrink tunnel 10 uses a shrinking process which is broken into stages so that the desired final package appearance is achieved. In a first stage, accomplished about six inches into the tunnel, a two inch stream 12 of heated water is directed onto the longitudinal seal located on the bottom of the package, thus removing wrinkles from the bottom seal area. In a second stage, two ⅜ inch streams 14 of water are directed onto the package at end seal height. These two streams are directed one from each side 16 of the tunnel, as the package travels down an incline 18 towards the center of the tunnel. The streams are located about 17 inches inside the tunnel. These streams cause shrinking of the sides and ends of the package. In a third stage, the package is then conveyed through heated water at a depth of about ½ inch in the tunnel reservoir area 20. The water in this area is kept at a temperature of about 212° F. by heat exchanger coils 22 in the reservoir bottom. In a fourth stage, the package is conveyed back up to the entry height where two fan shaped sprays 24 of heated water are directed onto the top of the package to shrink the product contact zone of the package. The heated water of sprays 24 is derived from the same water used in the earlier stages, so that partial cooking of the product in the package can occur.

Figure 3:
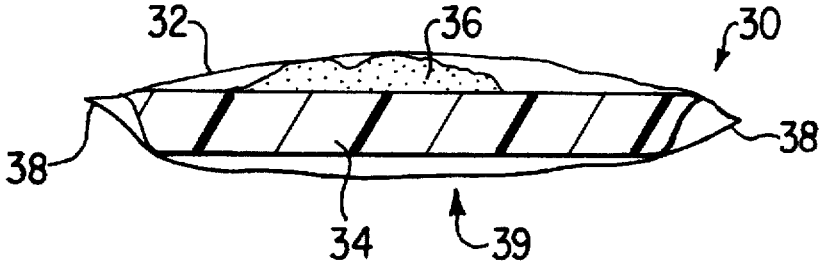
FIG. 3 shows a schematic cross section of a package used in connection with the invention.

Referring to FIG. 3, a package 30 used in connection with the invention comprises a heat shrinkable film 32 wrapped around a tray 34 containing a product 36.

The film is preferably an oriented heat shrinkable film. Examples of suitable materials for oriented, heat shrinkable film 32 include such olefinic materials as ethylene/vinyl acetate copolymer, ionomer, ethylene/alpha-olefin copolymer, especially homogeneous ethylene/alpha-olefin copolymer, ultra low density polyethylene ("ULDPE"), ethylene/nobutyl acrylate copolymer ("EnBA"), ethylene/methyl acrylate copolymer ("EMA"), low density polyethylene, and plasticized polyvinyl chloride. SSD-351™, SES™, and SSD-310™ stretch olefin films, obtainable from W. R. Grace & Co.-Conn., of Duncan, S.C., are suitable films for use in the present invention. The latter product is described in U.S. Pat. No. 4,617,241 incorporated herein by reference in its entirety. Preferred oriented, heat shrinkable films are at least partially crosslinked, preferably by electronic crosslinking.

The tray 34 is preferably foamed polystyrene, although the apparatus and process of the invention can be used in connection with any formed tray, foamed or unfoamed, or any substrate or support member, formed into a tray, or unformed.

The product 36 is preferably a food product, especially meat such as fresh red meat, smoked and processed meat, pork, poultry, and the like; cheese; or other food products.

End seal flaps 38 are formed when the package has been formed on packaging equipment such as the Ossid 500 E and EK and 750 systems, and various modifications of this machinery. These end flaps can be made by trim sealing, impulse sealing, hot bar sealing, or any other conventional means.

The film 32 of FIG. 3 is shown in an unshrunk condition, and separated along the bottom of the package from the bottom of the tray, for the sake of clarity.

Figure 4:
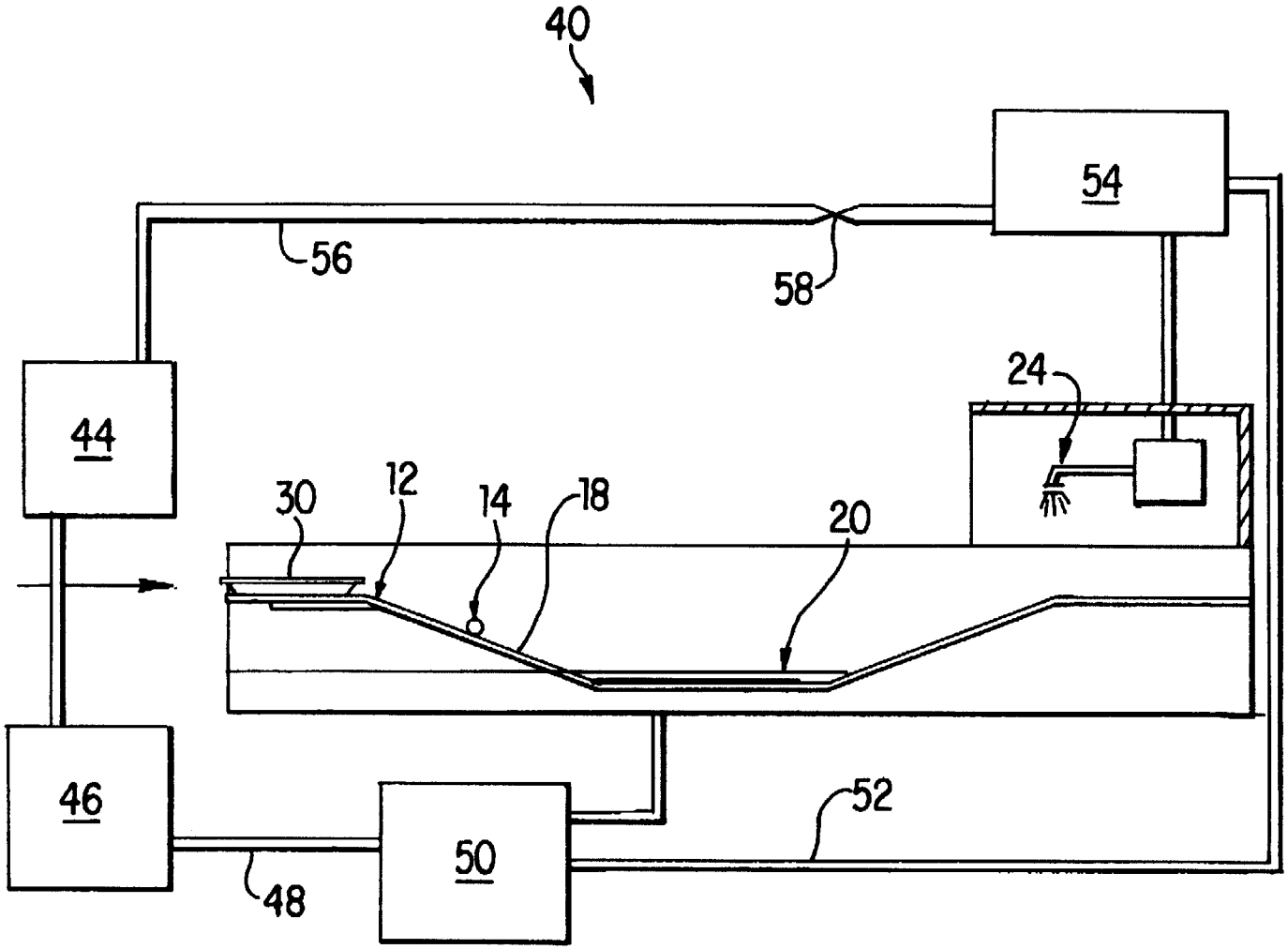
FIG. 4 shows the apparatus and process of the invention.

Referring to FIG. 4, after the package 30 has been made, it is transported either in-line, or in an off-line process, to the shrink system of the invention. A shrink tunnel 40 of any suitable size, shape, and capacity has a means for conveying a plurality of packages 30 through the tunnel. The physical components of a conventional hot water shrink tunnel are well known in the art, and those skilled in the art will understand that these components can be used in the apparatus and process of the invention. For example, a system like the RS 550S can be used, but with the improvements described herein.

A source of water 44 supplies a heat exchanger 46. The water is heated in the heat exchanger until it reaches a temperature of at least 180° F., preferably between 180° F. and 210° F., such as between 185° F. and 210° F., more preferably between 190° F. and 210° F., and most preferably between 195° F. and 205° F. The heated water passes through conduit 48 to a hot water reservoir 50. This reservoir supplies the lower portion 20 of the shrink tunnel with heated water. Suitable regulators (not shown) can be used to monitor and regulate the temperature of the heated water inside the tunnel.

As each package passes through the tunnel, the bottom 39 and end seals 38 of the package are contacted by the heated water. The packaging film in these areas of the package responds to the heat from the heated water and shrinks.

In a step simultaneous with, before, or after the shrinking of the film in the bottom and side areas of the package, a portion of the hot water in the reservoir 50 supplies, as needed, heated water via a conduit 52 to a second reservoir 54. The water source 44 passes water from the source 44, via conduit 56, to the second reservoir 54. The water from source 44 is typically at ambient or room temperature. The two water streams mix in reservoir 54 to provide water having a temperature of between 160° F. and 200° F., more preferably between 165° F. and 195° F., such as between 170° and 190° F., more preferably between 175° and 185° F. The streams can be regulated by means well known in the art, such as by a control valve 58, in order to provide the optimum water temperature for the particular package design, shrink tunnel configuration, product being packaged, ambient water temperature, and heated water temperature. The temperature of the water from the water source 44 can vary somewhat, and can be controlled by suitable heaters or chillers conventionally available.

It is preferred that the water from the water source, i.e. the water having a temperature lower than the heated water used in the lower portion of the shrink tunnel, has a temperature at least 1° F., preferably at least 5° F., such as at least 10°, 15°, 20° F., 25° F., 30° F., 35° F., or 40° F. cooler than the temperature of the heated water.

The mixed water of reservoir 54 is applied by a means for applying 24, such as sprayed through a means for spraying, or otherwise dripped, cascaded, or otherwise applied by any suitable means onto the top of each package. This step will complete the shrinking of the package, while providing a water temperature lower than that of heated water supplied to the lower portion 20 of the shrink tunnel. This results in less heat in the top area of the trayed product, which may result in less abuse to the print logo if any on the film. It also reduces or eliminates undesirable partial cooking of the packaged product.

After the shrinking of the film around the trayed product is complete, the package is moved out of the tunnel and packed off or further processed in a conventional manner.

Those skilled in the art will understand that modifications to the present invention can be made after review of the disclosure. Such modifications are deemed to be within the scope of the invention as claimed.

For example, one or more of the reservoirs and control valve disclosed herein can be eliminated in some cases, such that the heated water can be advanced directly to the shrink tunnel. Likewise, the second water reservoir 54 can be eliminated, and the two water streams can be merged directly and applied to the top of the package. This can be done either directly or via the means for applying 24. The water source can be simply tap water that is fed via a hose or other suitable connection or means into the second reservoir, or merged directly into the stream of heated water along conduit 52.

In lieu of, or in combination with a water source that provides water cooler than the heated water, a heat exchanger can be used to cool the heated water as it passes along conduit 52 toward the top of the shrink tunnel. In some cases, this may be sufficient to cool the heated water down to a temperature at which it can be beneficially applied to the top of the package.

What is claimed is:

1. A process for shrinking a package, the package having a top, end seals, and bottom, which process comprises:

a) heating water until the water reaches a temperature of between 180° F. and 210° F.;

b) applying a first portion of the heated water to the bottom and end seals of the package;

c) mixing a second portion of the heated water with water having a temperature lower than the heated water to provide cooled water; and d) applying the cooled water to the top of the package.

2. The process of claim 1 wherein, in step a), the water is heated to a temperature of between 190° F. and 210° F.

3. The process of claim 1 wherein, in step a), the water is heated by a heat exchanger.

4. The process of claim 1 wherein, in step b), the heated water is applied to the bottom and end seals of the package in the lower portion of a shrink tunnel.

5. The process of claim 4 wherein the water forms a bath through which the package is drawn.

6. The process of claim 1 wherein, in step c), the water having a temperature lower than the heated water has a temperature at least 5° F. lower than the heated water.

7. The process of claim 1 wherein, in step d), the cooled water is applied to the top of the package inside a shrink tunnel.

8. The process of claim 1 wherein the cooled water is sprayed onto the top of the package.

9. An apparatus for shrinking a package, the package having a top, end seals, and bottom, the apparatus comprising:

a) means for heating water until the water reaches a temperature of between 180° F. and 210° F.;

b) means for applying a first portion of the heated water to the bottom and end seals of the package;

c) means for mixing a second portion of the heated water with water having a temperature lower than the heated water to provide cooled water; and d) means for applying the cooled water to the top of the package.

10. The apparatus of claim 9 wherein the means for heating water comprises a heat exchanger.

11. The apparatus of claim 9 wherein the means for applying a first portion of the heated water to the bottom and end seals of the package comprises a shrink tunnel having a lower portion filled with the heated water through which the package can be drawn.

12. The apparatus of claim 9 wherein the apparatus of claim 9 wherein the means for applying a first portion of the heated water to the bottom and end seals of the package comprises a shrink tunnel having a lower portion with spray heads for spraying the heated water onto the bottom and end seals of the package.

13. The apparatus of claim 9 wherein the means for mixing a second portion of the heated water with water having a temperature lower than the heated water to provide cooled water comprises a reservoir.

14. The apparatus of claim 9 wherein the water having a temperature lower than the heated water has a temperature at least 5° F. lower than the heated water.

15. The apparatus of claim 9 wherein the means for applying the cooled water to the top of the package is located within a shrink tunnel.

16. The apparatus of claim 9 wherein the means for applying the cooled water to the top of the package comprises a spray head disposed in an upper portion of the shrink tunnel.

* * * * *

UNITED STATES PATENT AND TRADEMARK OFFICE

CERTIFICATE OF CORRECTION

PATENT NO. : 5,699,650

DATED : December 23, 1997

INVENTOR(S) : Stephen L. Gray

It is certified that error appears in the above-identified patent and that said Letters Patent is hereby corrected as shown below:

Column 6, line 18, delete "wherein the apparatus of claim 9"

Signed and Sealed this

Seventeenth Day of March, 1998

*Attest:*

Bruce Lehman

BRUCE LEHMAN

*Attesting Officer*

*Commissioner of Patents and Trademarks*